US011574784B2

(12) United States Patent
Yoo

(10) Patent No.: US 11,574,784 B2
(45) Date of Patent: Feb. 7, 2023

(54) DIRECT CURRENT RELAY

(71) Applicant: LS ELECTRIC CO., LTD., Anyang-si (KR)

(72) Inventor: Jungwoo Yoo, Anyang-si (KR)

(73) Assignee: LS ELECTRIC CO., LTD., Anyang-si (KR)

( * ) Notice: Subject to any disclaimer, the term of this patent is extended or adjusted under 35 U.S.C. 154(b) by 38 days.

(21) Appl. No.: 17/269,213

(22) PCT Filed: Aug. 13, 2019

(86) PCT No.: PCT/KR2019/010275
§ 371 (c)(1),
(2) Date: Feb. 17, 2021

(87) PCT Pub. No.: WO2020/045859
PCT Pub. Date: Mar. 5, 2020

(65) Prior Publication Data

US 2021/0193421 A1 Jun. 24, 2021

(30) Foreign Application Priority Data

Aug. 31, 2018 (KR) ..... 10-2018-0103719

(51) Int. Cl.
*H01H 3/00* (2006.01)
*H01H 50/56* (2006.01)
(Continued)

(52) U.S. Cl.
CPC ..... *H01H 50/56* (2013.01); *H01H 50/18* (2013.01); *H01H 50/36* (2013.01); *H01H 50/546* (2013.01)

(58) Field of Classification Search
CPC ..... H01H 50/56; H01H 50/18; H01H 50/36; H01H 50/546; H01H 9/443; H01H 1/54; H01H 33/596; H01H 2231/026
(Continued)

(56) References Cited

U.S. PATENT DOCUMENTS 4,513,270 A * 4/1985 Belbel ..... H01H 77/101 335/16
5,892,194 A * 4/1999 Uotome ..... H01H 51/065 335/154
(Continued)

FOREIGN PATENT DOCUMENTS

CN 103915294 A * 7/2014 ..... H01H 50/54
CN 105551897 A * 5/2016 ..... H01H 1/2008
(Continued)

OTHER PUBLICATIONS

International Search Report of PCT/KR2019/010275 dated Nov. 22, 2019.
(Continued)

*Primary Examiner* — Shawki S Ismail
*Assistant Examiner* — Lisa N Homza
(74) *Attorney, Agent, or Firm* — K&L Gates LLP

(57) ABSTRACT

The present disclosure relates to a direct current relay, and more specifically, to a direct current relay having a movable assembly with improved contact pressure. The direct current relay according to an embodiment of the present disclosure comprises a pair of fixed contacts, and a movable contact which is moved vertically by an electromagnetic force to contact or be separated from the pair of fixed contacts, wherein an upper yoke and a lower yoke are respectively provided on the upper and lower portions of the movable contact, a contact spring is provided on the lower portion of
(Continued)

the lower yoke, and the lower yoke is pressed by the contact spring to move the movable contact.

8 Claims, 7 Drawing Sheets

(51) Int. Cl.
*H01H 50/18* (2006.01)
*H01H 50/36* (2006.01)
*H01H 50/54* (2006.01)

(58) Field of Classification Search
USPC ..... 335/185
See application file for complete search history.

(56) References Cited

U.S. PATENT DOCUMENTS 8,269,585 B2 * 9/2012 Choi ..... H01H 1/2008 335/196
8,653,917 B2 * 2/2014 Takaya ..... H01H 9/443 335/131
9,613,771 B2 * 4/2017 Lim ..... H01H 1/54
2006/0050466 A1 * 3/2006 Enomoto ..... H01H 50/02 361/160
2009/0322454 A1 * 12/2009 Tanaka ..... H01H 50/38 335/189
2009/0322455 A1 * 12/2009 Yoshihara ..... H01H 50/36 335/189
2011/0032059 A1 * 2/2011 Ito ..... H01H 50/14 218/25
2011/0221548 A1 * 9/2011 Yoshihara ..... H01H 51/29 335/185
2013/0057369 A1 * 3/2013 Yano ..... H01H 51/00 335/156
2013/0115807 A1 5/2013 Enomoto et al.
2014/0014622 A1 * 1/2014 Naka ..... H01H 50/163 218/4
2015/0015350 A1 * 1/2015 Tachikawa ..... H01H 50/58 335/131
2015/0022291 A1 * 1/2015 Kashimura ..... H01H 3/28 218/148
2015/0022292 A1 * 1/2015 Tachikawa ..... H01H 50/641 335/131
2015/0022296 A1 * 1/2015 Takaya ..... H01H 50/04 335/201
2015/0034600 A1 * 2/2015 Isozaki ..... H01H 1/06 218/148
2015/0077202 A1 3/2015 Enomoto
2015/0187518 A1 * 7/2015 Molyneux ..... H01H 50/546 335/196
2015/0213985 A1 * 7/2015 Naka ..... H01H 50/648 335/189
2015/0213986 A1 * 7/2015 Naka ..... H01H 50/648 335/189
2015/0380145 A1 * 12/2015 Koch ..... H01F 7/1844 335/282
2016/0155592 A1 * 6/2016 Ito ..... H01H 50/60 335/187
2016/0260563 A1 * 9/2016 Shima ..... H01H 9/443
2016/0260566 A1 * 9/2016 Shima ..... H01H 50/54
2016/0300677 A1 * 10/2016 Park ..... H01H 9/443
2017/0110275 A1 * 4/2017 Yang ..... H01H 50/305
2018/0096811 A1 * 4/2018 Lee ..... H01H 50/026
2021/0175031 A1 * 6/2021 Yoo ..... H01H 33/596
2021/0193421 A1 * 6/2021 Yoo ..... H01H 50/36

FOREIGN PATENT DOCUMENTS

CN 209729832 U 12/2019
JP 2003-016902 A 1/2003
JP 2012022984 A 2/2012
JP 2012104359 A 5/2012
JP 5529658 B2 * 6/2014 ..... H01H 1/54
JP 2014232669 A 12/2014
JP 2018-133347 A 8/2018
KR 10-1034371 B1 5/2011
KR 10-2039323 B1 11/2019
WO 2014083769 A1 6/2014
WO WO-2014208098 A1 * 12/2014 ..... H01H 50/36

OTHER PUBLICATIONS

Korean Office Action of Korean Application No. KR 10-2018-0103719 dated Jan. 28, 2020—5 Pages.
Decision of Rejection of Korean Application No. KR 10-2018-0103719 dated May 18, 2020—4 Pages.
Decision of Rejection of Korean Application No. KR 10-2018-0103719 dated Jul. 1, 2020—4 Pages.
Request for prioritized examination of KR 10-2018-0103719; filed with KIPO dated Dec. 13, 2019.
Japanese Office Action for related Japanese Application No. 2021-508306; action dated Jan. 4, 2022; (9 pages).
Extended European Search Report for related European Application No. 19855322.4; action dated Apr. 21, 2022; (7 pages).

* cited by examiner

DIRECT CURRENT RELAY

CROSS-REFERENCE TO RELATED APPLICATIONS

This application is the National Stage filing under 35 U.S.C. 371 of International Application No. PCT/KR2019/010275, filed on Aug. 13, 2019, which claims the benefit of earlier filing date and right of priority to Korean Application No. 10-2018-0103719 filed on Aug. 31, 2018, the contents of which are all hereby incorporated by reference herein in their entirety.

TECHNICAL FIELD

The present disclosure relates to a direct current relay and, more particularly, to a direct current relay including a mover assembly having improved contact pressure.

BACKGROUND

In general, a direct current relay or a magnetic switch is a kind of electrical circuit switching device that allows mechanical operation and transmits current signal using principles of electromagnet, and is installed in various industrial facilities, machines, and vehicles.

In particular, electric vehicles such as hybrid vehicles, fuel cell vehicles, golf carts, and electric forklifts are equipped with an electric vehicle relay to supply and cut off power of a battery to a power generating device and an electrical equipment. And, such an electric vehicle relay is one of very important core components in electric vehicles.

FIG. 1 illustrates an internal structure of a direct current relay according to the related art.

The direct current relay includes a case 1, 2 including an upper frame 1 and a lower frame 2, a middle plate 9 provided inside the case, a contact portion 3, 4 and an arc-extinguishing portion 8 both installed above the middle plate 9, and an actuator 7 installed under the middle plate 9. Here, the actuator 7 may be a device that operates by the principles of electromagnet.

At an upper surface of the upper frame 1, a fixed contact 3 of the contact portion 3, 4 is exposed so as to be connected to a load or power source.

The contact portion 3, 4 and the arc-extinguishing portion 8 are provided inside the upper frame 1. The contact portion 3, 4 includes the fixed contact 3 fixedly installed in the upper frame 1, and a movable contact 4 actuated by the actuator 7 so as to be brought into contact with or separated from the fixed contact 3. The arc-extinguishing portion 8 is usually made of a ceramic material. The arc-extinguishing portion 8 is also referred to as an arc chamber. Inside the arc-extinguishing portion 8, there may be filled with extinguishing gas for arc extinguishing.

To effectively control an arc generated when the contact portion 3, 4 is cutoff (or separated), a permanent magnet (not illustrated) may be provided. The permanent magnet is installed around the contact portion to generate a magnetic field to control the arc, which is a rapid flow of electricity, and a permanent magnet holder 6 is provided to fix the permanent magnet.

The actuator is operated using the principles of electromagnet and includes a fixed core 7*a*, a movable core 7*b*, a movable shaft 7*c*, and a return spring 7*d*. A cylinder 7*e* surrounds the fixed core 7*a* and the movable core 7*b*. The cylinder 7*e* and the arc-extinguishing portion 8 form a closed space.

A coil 7*f* is provided around the cylinder 7*e*, and when a control power is applied, an electromagnetic force is generated around the cylinder 7*e*. The fixed core 7*a* is magnetized by the electromagnetic force generated by the coil 7*f*, and the movable core 7*b* is attracted by a magnetic force of the fixed core 7*a*. Accordingly, the movable shaft 7*c* coupled to the movable core 7*b* and the movable contact 4 coupled to an upper portion of the movable shaft 7*c* move together to be brought into contact with the fixed contact 3 so that the circuit is energized. The return spring 7*d* provides an elastic force to the movable core 7*b* to allow the movable core 7*b* to return to its initial position when the control power of the coil is cut off.

However, in the direct current relay according to the related art, an electromagnetic repulsive force is generated between the fixed contact and the movable contact, and thus the fixed contact and the movable contact tend to be separated from each other. In order to prevent unintentional separation due to such an electromagnetic repulsive force, the movable contact 4 receives a contact pressure from a contact pressure spring 5. In other words, a distance between the fixed core 7*a* and the movable core 7*b* is set longer than a distance between the fixed contact 3 and the movable contact 4, so that the movable contact receives a contact pressure due to an over travel of the movable core. However, when the electromagnetic repulsive force is stronger than the contact pressure, there is still a risk of separation of the contact portion.

SUMMARY

The present disclosure is to solve those problems, and an aspect of the present disclosure is to provide a magnetic contactor provided with a mover assembly that improves a contact pressure.

A direct current relay according to an embodiment of the present disclosure including a pair of fixed contacts, and a movable contact moved vertically by an electromagnetic force to be brought into contact with or be separated from the pair of fixed contacts, includes an upper yoke and a lower yoke respectively provided on an upper portion and a lower portion of the movable contact, and a contact pressure spring provided on a lower portion of the lower yoke, wherein the contact pressure spring is configured to press the lower yoke to move the movable contact.

Here, the direct current relay further includes a mover support configured to support the movable contact, the upper yoke, and the lower yoke, and a mover holder fixed to an upper portion of the mover support.

In addition, the mover support includes a first flat plate portion, and arm portions protruding upwardly from opposite side ends of the first flat plate portion to which the mover holder is fixed.

In addition, an upper portion of the first flat plate portion is provided with a spring support portion protruding therefrom to support a lower end of the contact pressure spring.

In addition, a lower surface of the mover support is provided with an insertion portion protruding therefrom to be inserted in a central hole of a middle plate.

In addition, the mover holder includes a second flat plate portion, and side surface portions bent downwardly at opposite side ends of the second flat plate portion.

In addition, a left side surface and a right side surface of the mover holder are respectively provided with a skirt portion to receive the upper yoke therein.

In addition, the lower yoke includes a third flat plate portion, and wing portions bent upwardly at opposite side ends of the third flat plate portion.

In addition, a front end portion and a rear end portion of the upper yoke are respectively provided with a coupling groove to which the wing portion is coupled.

In addition, a front side surface and a rear side surface of the movable contact are respectively provided with a support groove in which the wing portion is inserted.

In addition, a lower surface of the lower yoke is provided with a support protrusion onto which an upper end portion of the contact pressure spring is fixed.

In addition, the upper yoke is disposed on an upper portion or a lower portion of the mover holder.

A direct current relay according to another aspect of the present disclosure includes a pair of fixed contacts, and a mover assembly moved vertically by an actuator to be brought into contact with or separated from the pair of fixed contacts so as to energize or cut off a circuit, wherein the mover assembly includes a mover support connected to the actuator by a shaft, a mover holder fixed to an upper portion of the mover support, a movable contact installed between the mover holder and the mover support, an upper yoke and a lower yoke respectively provided on an upper portion and a lower portion of the movable contact to generate an electromagnetic force, and a contact pressure spring provided between the lower yoke and the mover support to press the lower yoke, and wherein the mover assembly is arranged such that the upper yoke, the mover holder, the movable contact, the lower yoke, the contact pressure spring, and the mover support are sequentially arranged from top to bottom, or the mover holder, the upper yoke, the movable contact, the lower yoke, the contact pressure spring, and the mover support are sequentially arranged from top to bottom.

According to a direct current relay according to each of embodiments of the present disclosure, since a movable contact is provided with an upper yoke and a lower yoke to offset an electromagnetic repulsive force, a contact portion is not unintendedly separated.

DETAILED DESCRIPTION

Hereinafter, preferred embodiments of the present disclosure will be described with reference to the accompanying drawings, but this is to explain in detail enough for those skilled in the art to easily implement the disclosure, and it does not mean that the technical idea and scope of the disclosure are limited thereto.

Figure 1:
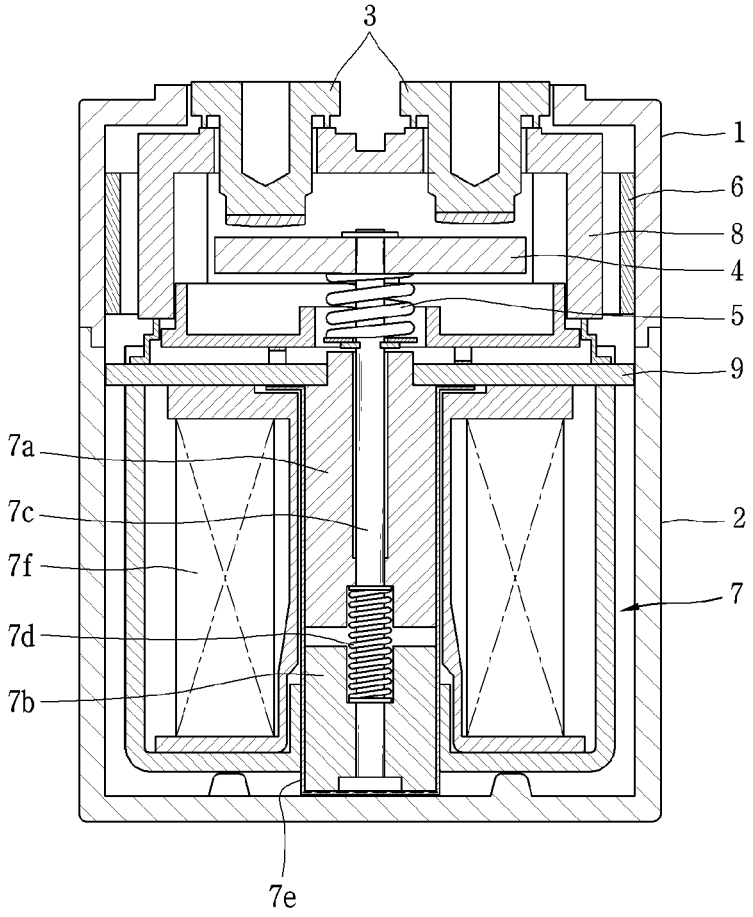
Fig. 1 Prior Art
FIG. 1 is a view of an internal structure of a direct current relay according to the related art.
Figure 2:
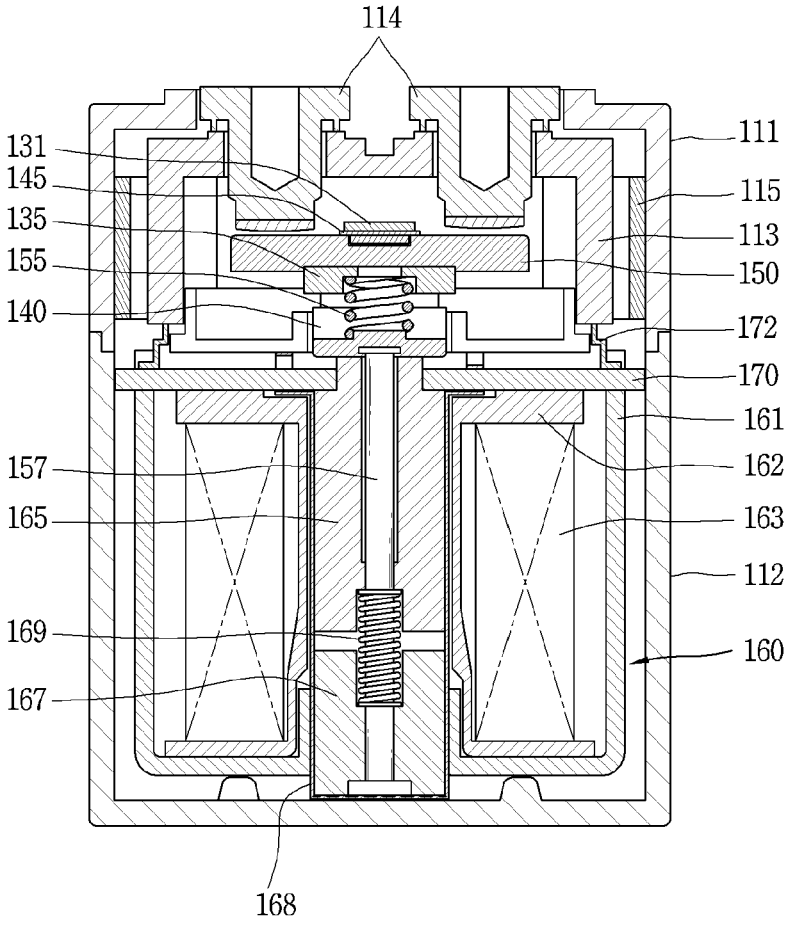
FIG. 2 is a view of an internal structure of a direct current relay according to an embodiment of the present disclosure.
Figure 3:
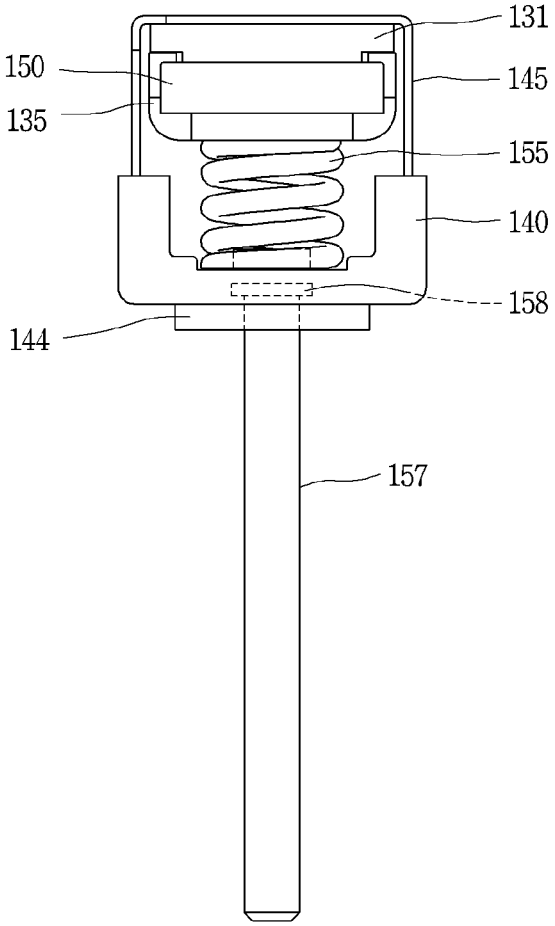
FIG. 3 is a side view of a mover assembly in FIG. 2.
Figure 4:
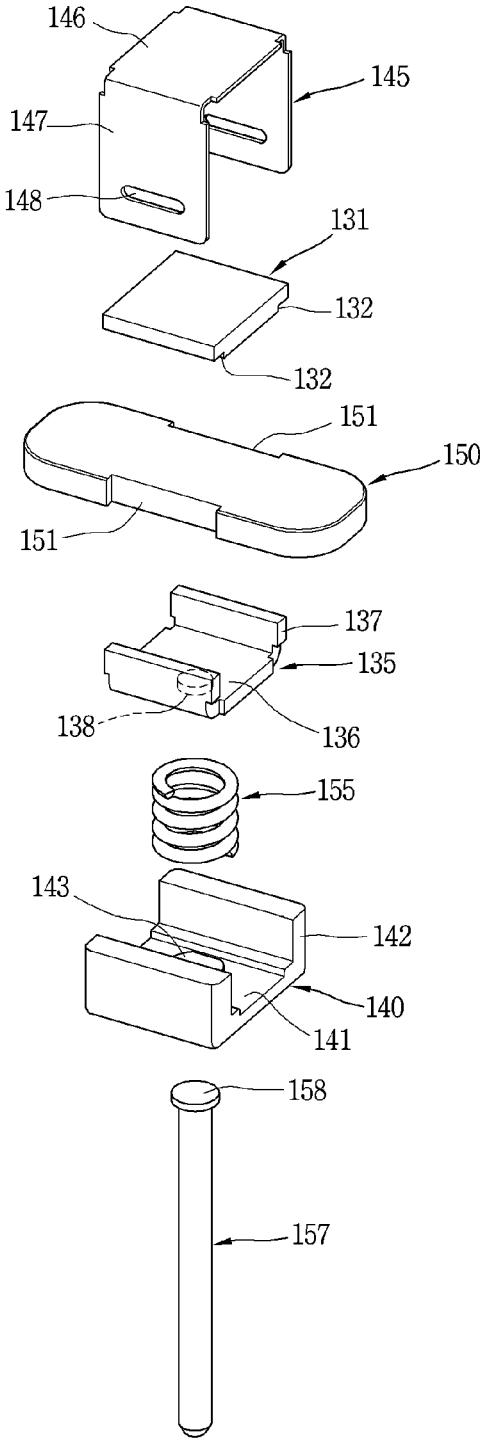
FIG. 4 is an exploded perspective view of the mover assembly of FIG. 3.

FIG. 2 is a view of an internal structure of a direct current relay according to an embodiment of the present disclosure, FIG. 3 is a side view of a mover assembly in FIG. 2, and FIG. 4 is an exploded perspective view of the mover assembly of FIG. 3. Hereinafter, a direct current relay according to each embodiment of the present disclosure will be described in detail with reference to the drawings.

A direct current relay according to an embodiment of the present disclosure including a pair of fixed contacts 114 and a movable contact 150 moved vertically by an electromagnetic force to be brought into contact with or be separated from the pair of fixed contacts 114, includes an upper yoke 131 and a lower yoke 135 respectively provided on an upper portion and a lower portion of the movable contact 150, and a contact pressure spring 155 provided on a lower portion of the lower yoke 135, wherein the contact pressure spring 155 is configured to press the lower yoke 135 to move the movable contact 150.

A frame 111, 112 is defined as a box-shaped case to contain, protect, and support components therein. The frame 111, 112 may include an upper frame 111 and a lower frame 112.

An arc chamber 113 is defined in a box shape with an open lower surface, and is installed inside the upper frame 111. The arc chamber 113 is made of a material having excellent insulating property, pressure resistance, and heat resistance so as to extinguish an arc generated at the contact portion 114, 150 upon cutoffs. For example, the arc chamber 113 may be made of a ceramic material. The arc chamber 113 is fixedly installed above a middle plate 170.

The fixed contacts 114 are provided in a pair and fixedly installed on the arc chamber 113. The pair of fixed contacts 114 is exposed at the upper frame 111. One of the fixed contacts 114 may be connected to a power side, and another one of the fixed contacts 14 may be connected to a load side.

The movable contact 150 is defined as a plate-shaped body having a predetermined length, and is installed under the pair of fixed contacts 114. The movable contact 150 is installed in a mover assembly 130 to be moved integrally. Accordingly, the movable contact 150 moves linearly up and down by an actuator 160 installed inside the lower frame 112 to connect or disconnect a circuit by being brought into contact with or separated from the fixed contacts 114.

To effectively control the arc generated when the contact portion 114, 150 is cutoff (or separated), a permanent magnet (not illustrated) is provided. The permanent magnet is installed around the contact portion 114, 150 to generate a magnetic field to control the arc, which is a rapid flow of electricity. And, to fix the permanent magnet, a permanent magnet holder 115 is provided.

The actuator 160 is provided to move the mover assembly 130, that is, the movable contact 150. The actuator 160 may include a yoke 161 defined in a 'U' shape and forming a magnetic circuit, a coil 163 wound around a bobbin 162 installed inside the yoke 161 to generate a magnetic field by receiving an external power source, a fixed core 165 fixedly installed inside the coil 163 to generate a magnetic attraction force by being magnetized due to a magnetic field generated by the coil 163, a movable core 167 installed to be linearly movable under the fixed core 165 so as to be brought into contact with or separated from the fixed core 165 by the magnetic attraction force of the fixed core 165, a shaft 157 in which a lower end thereof is coupled to the movable core 167 and an upper end thereof is slidably inserted through the movable contact 150, a return spring 169 installed between the fixed core 165 and the movable core 167 so as to move the movable core 167 downwardly back to its original position, and a cylinder 168 to accommodate the fixed core 165, the movable core 167, and the return spring 169.

Between the actuator 160 and the arc chamber 113, there is provided the middle plate 170. The middle plate 170 is installed at an upper portion of the yoke 161 and made of a magnetic material to form a magnetic circuit together with the yoke 161. The middle plate 170 also serves as a support plate on which the arc chamber 113 at the upper portion and the actuator 160 at the lower portion may be installed, respectively. The cylinder 168 may be hermetically coupled to a bottom portion of the middle plate 170.

Between the middle plate 170 and the arc chamber 113, there may be provided a sealing member 172. The sealing member 172 is provided along a lower circumference of the arc chamber 113 to seal a space formed by the arc chamber 113, the middle plate 170 (a hole in a central portion of the middle plate), and the cylinder 168.

The mover assembly 130 includes the shaft 157, the mover support 140, the mover holder 145, the movable contact 150, the contact pressure spring 155, the upper yoke 131, and the lower yoke 135.

The shaft 157 is implemented as a straight rod. A lower end of the shaft 157 is fixedly installed in the movable core 167. Accordingly, the shaft 157 moves up and down together with the movable core 167 according to a movement of the movable core 67 to thereby allow the movable contact 150 to be brought into contact with or separated from the fixed contact 114.

At an upper end portion of the shaft 157, a coupling portion 158 is formed. The coupling portion 158 may be defined in a plate shape, for example, a disk shape. The coupling portion 158 of the shaft 157 is fixedly coupled inside the mover support 140. The coupling portion 158 of the shaft 157 may be manufactured in, for example, an insert-molding manner in which the coupling portion 58 is coupled into the mover support 140.

The mover support 140 with the shaft 157 fixedly installed thereon is provided to support the movable contact 150 and the likes. The mover support 140 includes a first flat plate portion 141, and arm portions 142 protruding upwardly from opposite side ends of the first flat plate portion 141.

An upper surface of the first flat plate portion 141 of the mover support 140 is provided with a spring support portion 143 protruding therefrom.

At the arm portion 142 of the mover support 140, the mover holder 145 fixedly installed.

When viewed from front (see FIGS. 2 and 4), a length (in a left-right direction) of the first flat plate portion 141 is shorter than a length (in the left-right direction) of the movable contact 150. Accordingly, contact tips of the movable contact 150 are exposed to opposite sides of the mover support 140, respectively.

A width (in a front-rear direction) of an inner surface (or the upper surface) of the first flat plate portion 141 may be smaller than a width (in the front-rear direction) of the movable contact 150. Accordingly, the mover holder 145 may be stably inserted into the arm portion 142 of the mover support 140 (see FIG. 3).

A lower surface of the mover support 140 is provided with the insertion portion 144 protruding therefrom to be inserted in a central hole (not shown) of the middle plate 170. The insertion portion 144 may be defined in a disk shape. Since the insertion portion 144 is formed at the lower surface of the mover support 140 and is fitted to the middle plate 170, a stability of the mover assembly 130 is improved.

The mover holder 145 is provided to support the movable contact 150, the upper yoke 131, and the lower yoke 135.

The mover holder 145 is fixedly installed on the mover support 140. The mover holder 145 is defined in a '⊏' shape. That is, the mover holder 145 includes a second flat plate portion 146 and opposite side surface portions 147. The opposite side surface portions 147 are bent downwardly at opposite side ends of the second flat plate portion 146.

A width (or a length in the left-right direction) of the second flat plate portion 146 may be smaller than the length of the movable contact 150. Accordingly, contact tips of the movable contact 150 are exposed to opposite sides of the mover holder 145, respectively.

The side surface portion 147 extends downwardly from the second flat plate portion 146. The side surface portion 147 is inserted into the arm portion 142 of the mover support 140.

A width (or a length in the left-right direction) of the side surface portion 147 may be equal to the width of the second flat plate portion 146.

The side surface portion 147 is provided with a hole 148. Accordingly, a bonding force may increase in an insert-molding structure.

The upper yoke 131 is installed under the mover support 145. The upper yoke 131 may be defined in a plate shape. A width of the upper yoke 131 may be equal to a width of the mover holder 145.

A lower surface of the upper yoke 131 is provided with coupling grooves 132 to which the lower yoke 135 is coupled. The coupling grooves 132 may be formed at a front end portion and a rear end portion, respectively.

The movable contact 150 is installed to be brought into contact with a lower surface of the upper yoke 131. The upper yoke 131 and the movable contact 150 may not be fixed to the mover holder 145 and may be separable from the mover holder 145. Accordingly, when the mover assembly 130 moves upward, the movable contact 150 is separated from the second flat plate portion 146 so as to be brought into close contact with the fixed contact 114 by receiving a contact pressure from the contact pressure spring 155.

Front and rear side surfaces of the movable contact 150 are provided with support grooves 151. Onto the support grooves 151, wing portions 137 of the lower yoke 135 are inserted.

The movable contact 150 is surrounded by the upper yoke 131 and the lower yoke 135.

The lower yoke 135 is installed under the movable contact 150. The lower yoke 135 may include a third flat plate portion 136, and the wing portions 137 bent upwardly at opposite side ends of the third flat plate portion 136.

The contact pressure spring 155 applies a contact pressure to the movable contact 150 through the lower yoke 135. Accordingly, the contact pressure spring 155 may apply a contact pressure without damaging the movable contact 150, thereby improving safety.

The wing portions 137 of the lower yoke 135 are fitted into the support grooves 151 of the movable contact 150 and the coupling grooves 132 of the upper yoke 131. Accordingly, even if the upper yoke 131, the movable contact 150, and the lower yoke 135 are separated from the mover holder 145, they do not escape and maintain their mutual coupling force.

The lower yoke 135 is provided with a support protrusion 138 onto which the contact pressure spring 155 may be mounted. Since an upper end of the contact pressure spring 155 is fitted onto the support protrusion 138 of the lower yoke 135, the contact pressure spring 155 does not escape from the lower yoke 135 and an operation stability is improved.

When the circuit is energized, the upper yoke 131 and the lower yoke 135 respectively provided above and below the movable contact 150 are magnetized, and the lower yoke 135 receives a force drawn by the upper yoke 131. Accordingly, the movable contact 150 receives a force upwardly to offset an electromagnetic repulsive force generated at the contact portion 114, 150.

The contact pressure spring 155 is provided between the lower yoke 135 and the mover support 140. The contact pressure spring 155 is provided to support the movable contact 150 and provide a contact pressure to the movable contact 150 when energized. The contact pressure spring 155 may be implemented as a compression coil spring.

The upper end of the contact pressure spring 155 is fitted onto the support protrusion 138 of the lower yoke 135, and a lower end of the contact pressure spring 155 is fitted onto a spring support portion 143 of the mover support 140, and therefore, an installation state of the contact pressure spring 155 is stably maintained.

Since the contact pressure spring 155 is brought into direct contact with the lower yoke 135, it does not damage the movable contact 150. And, this increases durability.

Figure 5:
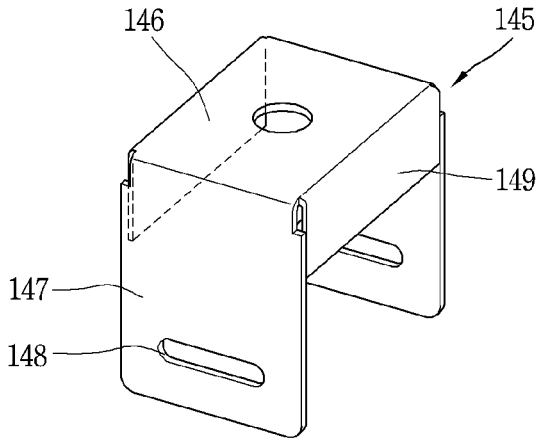
FIG. 5 is a perspective view of a mover holder applied to a direct current relay according to another embodiment of the present disclosure.

Hereinafter, a mover holder of a mover assembly of a direct current relay according to another embodiment of the present disclosure will be described with reference to FIG. 5.

Components other than a mover holder 145 in the mover assembly of this embodiment may be same as or similar to those in the previous embodiment.

Unlike the previous embodiment, the mover holder 145 is provided with skirt portions 149 at its left and right side surfaces. Accordingly, the upper yoke 131 is inserted in a space created by the side surface portions 147 and the skirt portions 149 of the mover holder 145. Accordingly, even if the lower yoke 135 moves vertically, the lower yoke 135 does not completely deviate from the skirt portions 149 of the mover holder 145. Therefore, the lower yoke 135 does not escape from the space.

Figure 6:
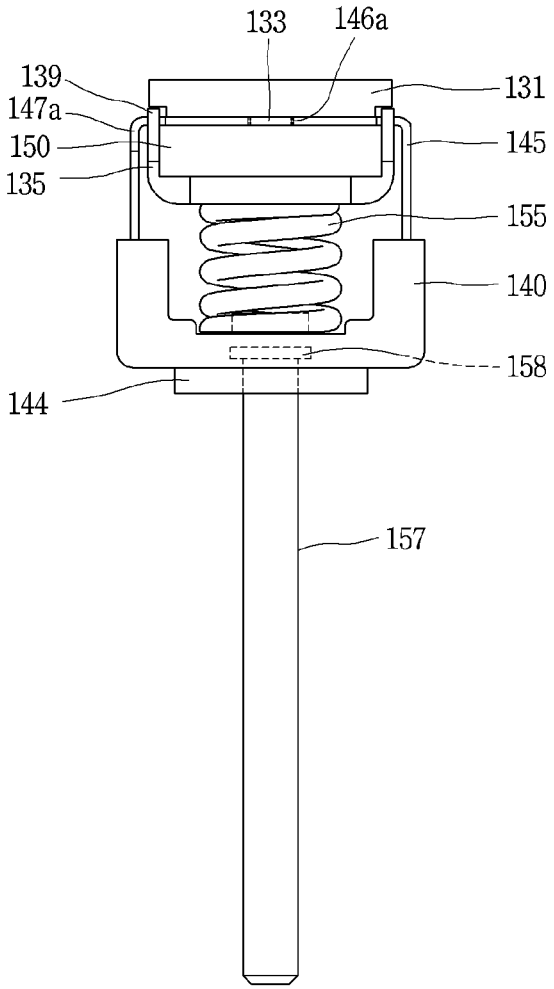
FIG. 6 is a side view.
Figure 7:
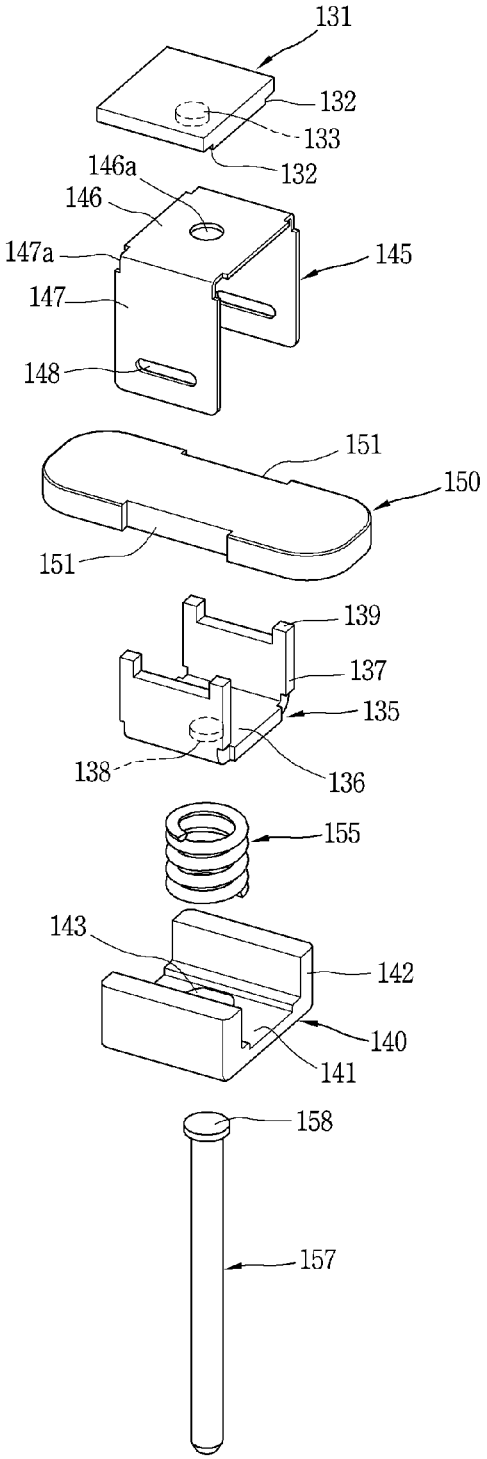
FIG. 7 is an exploded perspective view of a mover assembly applied to a direct current relay according to still another embodiment of the present disclosure.

Hereinafter, a mover holder of a mover assembly of a direct current relay according to still another embodiment of the present disclosure will be described with reference to FIGS. 6 and 7.

Components other than a mover holder 135, an upper yoke 131, and a lower yoke 135 in the mover assembly of this embodiment may be same as or similar to those in a first embodiment.

In this embodiment, the upper yoke 131 is disposed above the mover holder 145. In other words, the mover holder 145 is disposed between the upper yoke 131 and the movable contact 150. Respective size of the mover holder 145 and the upper yoke 131 is changed appropriately. An upper surface of the mover holder 145 is provided with a through hole 146*a* formed therethrough, and a support portion 133 of the upper yoke 131 is inserted therethrough. Each corner of the wing portion 137 of the lower yoke is provided with a fixing protrusion 139, and the fixing protrusion 139 passes through a connection groove 147*a* of the mover holder 145 so as to be fitted into a coupling groove 132 of the upper yoke 131. Since the mover holder 145 is brought into direct contact with the movable contact 150, an operation stability is improved.

A main difference between this embodiment and the first embodiment is an arrangement order. In the first embodiment, the mover holder 145, the upper yoke 131, the movable contact 150, the lower yoke 135, and the mover support 140 are sequentially arranged from top to bottom. However, in this embodiment, the upper yoke 131, the mover holder 145, the movable contact 150, the lower yoke 135, and the mover support 140 are sequentially arranged from top to bottom.

According to the direct current relay according to each of the embodiments of the present disclosure, since the movable contact is provided with the upper yoke and the lower yoke to offset an electromagnetic repulsive force, the contact portion is not unintendedly separated.

The foregoing embodiments are to implement embodiments of the present disclosure. Therefore, those skilled in the art to which the present disclosure pertains various modifications and variations will be possible without departing from the essential characteristics of the present disclosure. Therefore, the embodiments disclosed in the present disclosure are not intended to limit the technical idea of the present disclosure but to describe the present disclosure, and the scope of the technical idea of the present disclosure is not limited by these embodiments. The true scope of the present disclosure should be interpreted by the following claims, and all technical ideas within the equivalent scope should be interpreted as being included in the scope of the present disclosure.

The invention claimed is:

1. A direct current relay comprising a pair of fixed contacts and a movable contact moved vertically by an electromagnetic force to be brought into contact with or be separated from the pair of fixed contacts, comprising:

an upper yoke and a lower yoke respectively provided on an upper portion and a lower portion of the movable contact; and a contact pressure spring provided on a lower portion of the lower yoke, wherein the contact pressure spring is configured to press the lower yoke to move the movable contact, wherein the lower yoke comprises a third flat plate portion, and wing portions bent upwardly at opposite side ends of the third flat plate portion, wherein a front end portion and a rear end portion of the upper yoke are respectively provided with a coupling groove to which the wing portions are coupled, and wherein a front side surface and a rear side surface of the movable contact are respectively provided with a support groove in which the wing portion is inserted.

2. The direct current relay of claim 1, further comprising:

a mover support configured to support the movable contact, the upper yoke, and the lower yoke; and a mover holder fixed to an upper portion of the mover support.

3. The direct current relay of claim 2, wherein the mover support comprises a first flat plate portion, and arm portions protruding upwardly from opposite side ends of the first flat plate portion to which the mover holder is fixed.

4. The direct current relay of claim 3, wherein an upper portion of the first flat plate portion is provided with a spring support portion protruding therefrom to support a lower end of the contact pressure spring.

5. The direct current relay of claim 2, wherein a lower surface of the mover support is provided with an insertion portion protruding therefrom to be inserted in a central hole of a middle plate.

6. The direct current relay of claim 2, wherein the mover holder comprises a second flat plate portion, and side surface portions bent downwardly at opposite side ends of the second flat plate portion.

7. The direct current relay of claim 2, wherein the upper yoke is disposed on an upper portion or a lower portion of the mover holder.

8. The direct current relay of claim 1, wherein a lower surface of the lower yoke is provided with a support protrusion onto which an upper end portion of the contact pressure spring is fixed.

* * * * *